United States Patent [19]

Greenig

[11] 4,062,321

[45] Dec. 13, 1977

[54] FLUID SUPPORTED BELT ABOUT CYLINDRICAL MANDREL FOR TRANSPORTING MAGNETIC PARTICLES

[75] Inventor: Nelson L. Greenig, Norristown, Pa.

[73] Assignee: Sperry Rand Corporation, New York, N.Y.

[21] Appl. No.: 780,637

[22] Filed: Mar. 23, 1977

[51] Int. Cl.[2] ..... B05C 5/02

[52] U.S. Cl. ..... 118/623; 346/153; 198/811; 226/97; 101/DIG. 13

[58] Field of Search ..... 101/DIG. 5, 407 R, 368, 101/DIG. 13, 426; 226/97; 118/623, 624; 346/153; 360/102; 355/3 DD; 198/811

[56] References Cited

U.S. PATENT DOCUMENTS

| | | | |
|---|---|---|---|
| 2,954,006 | 9/1960 | Lawrence | 101/DIG. 13 |
| 3,267,840 | 8/1966 | Honma et al. | 101/DIG. 13 |
| 3,273,496 | 9/1966 | Melmon | 101/DIG. 13 |
| 3,435,441 | 3/1969 | Stahler | 360/102 |
| 3,495,268 | 2/1970 | Hurst | 226/97 |
| 3,620,430 | 11/1971 | Baumann | 226/97 |
| 3,701,135 | 10/1972 | Price | 226/97 |
| 3,741,117 | 6/1973 | Bieuent et al. | 101/DIG. 13 X |
| 3,741,790 | 6/1973 | Wu | 101/DIG. 13 X |

OTHER PUBLICATIONS

RCA Technical Notes, Levine et al., "Flotation and Edge Guiding of Paper Web for Electrostatic Printing Press," No. 457, Sept. 1961.

*Primary Examiner*—Mervin Stein

*Attorney, Agent, or Firm*—Thomas J. Scott; Sheldon Kapustin

[57] ABSTRACT

Apparatus including means for fluidically supporting and guiding a moving, cylindrically formed thin metal belt used in the transport of magnetic particles. Magnet pole pieces disposed adjacent the surface of the belt accommodate formation thereon of a non-translating, rotating bead of dry magnetic ink particles in the application of a uniform ink coating over the belt suitable for printing. The belt is held in substantially fluid tight relation along its opposed edges on bearing means affording rotation of the belt about a fixed, axially extending mandrel including fluid supply cavities and a magnet support cavity. The fluid supply cavities terminate in radially presented recessed orifices for discharging a fluid into a relatively close space provided between the mandrel and the belt, to the side of the latter opposite the surface on which the ink bead is formed by a magnet disposed within the magnet cavity. Introduction of fluid under pressure into the close space causes the belt to assume such shape and rigidity as is afforded by a solid cylinder, while maintaining optimum magnet-to-belt spacing.

11 Claims, 4 Drawing Figures

FLUID SUPPORTED BELT ABOUT CYLINDRICAL MANDREL FOR TRANSPORTING MAGNETIC PARTICLES

BACKGROUND OF THE INVENTION

This invention relates to apparatus for transporting magnetic particles, and more particularly to improvements in apparatus for transporting finely divided dry magnetic ink particles and presenting the same in a uniform layer for transfer to suitable receptor means.

In the art of non-impact printing using dry magnetic ink, it is a known practice to transfer magnetic ink characters to a paper web by passing the web between an ink source and selectively energizable electrostatic print heads. It is also a known practice to form a latent magnetic image on the magnetizable surface of a drum as the receptor means, and to a develop the latent image by deposition thereon of finely divided particles of magnetic ink, which adhere only to the magnetized image areas. The adherent ink is then transferred from the drum to a paper web, or the like, and the ink image is made permanent by a suitable fixing process.

For any of the foregoing or other known similar systems, printing quality is a function of the degree of uniformity of ink transfer, and to this end resort has been had to belts for transporting the ink in a uniform layer for transfer to the receptor means.

In one known, preferred apparatus, a non-translating, rotating dry magnetic ink bead is formed, by suitably positioned magnet means, along a transverse surface portion of a transport belt, and the rotating ink bead operates uniformly to distribute the magnetic ink over the surface of the belt for subsequent transfer to the receptor means.

Difficulties have been encountered, however, in apparatus of this type, since the bead-forming magnet means must include flux forming elements disposed to the side of the belt opposite the ink, so that the magnetic flux extends through the surface of the belt with sufficient strength and concentration to form a well defined bead of ink. A thin, flexible belt of a material such as nickel meets this requirement, but due to its inherent lack of rigidity has been found difficult to guide and support in order to maintain suitable dimensional tolerances. Known belt guiding and supporting means achieving these tolerances have been found to introduce cyclic strains in the belt, leading to untimely belt failure.

It is a general objective of this invention to provide improved means for transporting magnetic particles for presentation in a uniform layer in a transfer region.

It is a further general objective of this invention to provide improved dry magnetic ink transporting apparatus capable of presenting a uniform layer of magnetic ink in a region of transfer thereof to suitable receptor means.

Another object of the invention is to provide improved means for forming and maintaining a non-translating, rotating dry magnetic ink bead on the surface of a rotatable ink transporting belt to form a uniform layer of ink thereon.

A still further and more specific objective of this invention is to provide improved means for supporting and guiding a thin, flexible, cylindrically configured rotatable dry magnetic ink transport belt in close proximity to magnet pole pieces disposed adjacent the belt to form a non-translating, rotating bead of ink thereon.

SUMMARY OF THE INVENTION

In achievement of the foregoing as well as other objectives and advantages, the invention contemplates improvements in magnetic particle transporting apparatus of the type in which an endless metal belt is passed across magnet means effective to form a non-translating rotating bead of magnetic particles, for example dry magnetic ink, across the direction of travel of said belt for the distribution of said particles in a uniform layer for removal from said belt in a transfer region, which improvements comprise: rotatable means for supporting said belt in the shape of a cylinder along edge regions thereof and providing for rotation of said belt about its axis of curvature; and means for introducing fluid under pressure in the region enclosed by said belt uniformly to urge said cylindrically formed belt outwardly, effectively rigidifying the same to maintain predetermined optimum spacing between said belt and said magnet means for the recited formation of said bead of particles.

The manner in which the objectives and advantages of the invention may best be achieved will be more fully understood from a consideration of the following description, taken in light of the accompanying drawing.

DESCRIPTION OF THE PREFERRED EMBODIMENT

Figure 1:
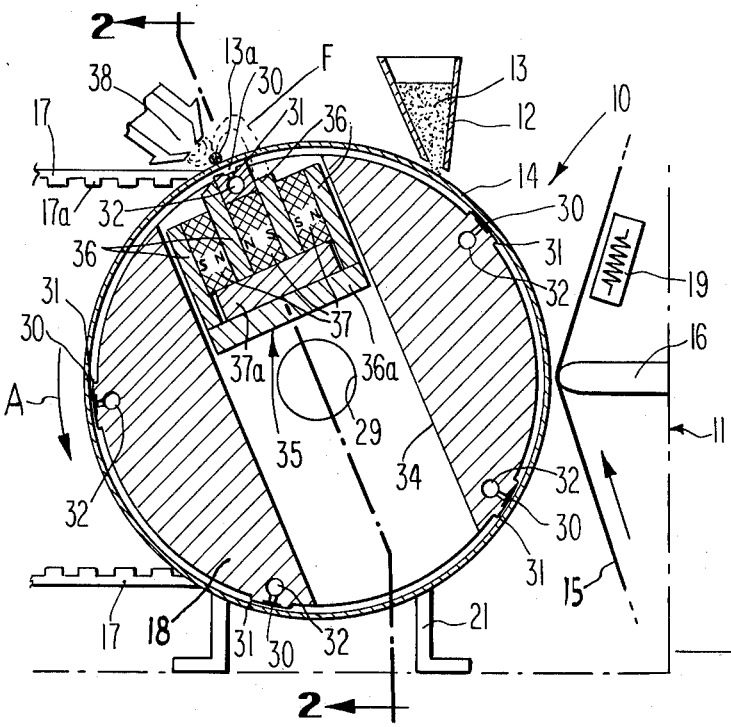
FIG. 1 is a sectional view of a dry magnetic ink printing apparatus embodying the invention.

With more detailed reference to the drawing, and first to FIG. 1, a dry magnetic ink printing apparatus 10 is supported on suitable frame structure designated generally by the numeral 11. Apparatus 10 includes an ink supply hopper 12 of conventional construction and positioned to disperse dry magnetic ink powder 13 over the outer surface of a rotatable, cylindrically formed belt 14. Rotation of belt 14 is counter-clockwise as indicated by arrow A, about its axis of curvature. Ink transported by the belt 14 is transferred to a strip of paper 15 caused to move adjacent the belt, over an electrostatic printing head 16 of known type, and past a fixing device such as radiant heater 19. Rotation of belt 14 is afforded by a suitably driven pair of cog belts 17 in concert with suitable belt-supporting bearing means, as will be described in more detail in connection with FIG. 2.

Figure 2:
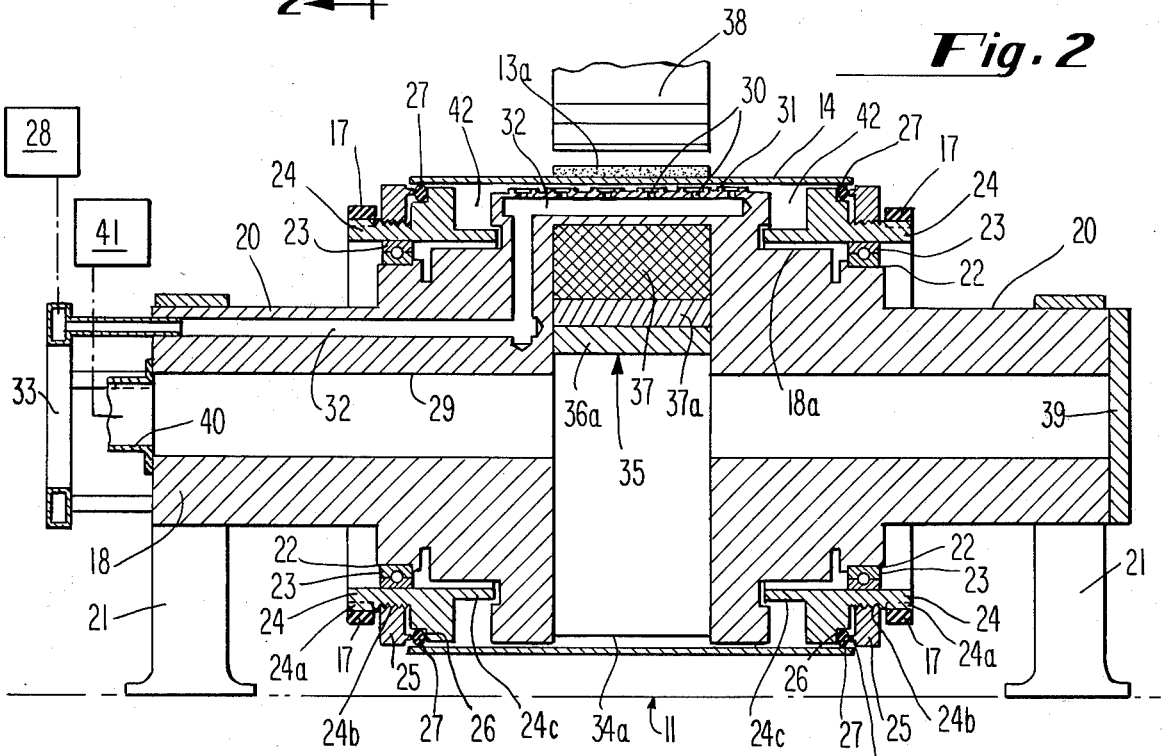
FIG. 2 is a sectional showing of apparatus seen in FIG. 1, and taken along the line 2—2 looking in the direction indicated by arrows applied thereto.

With further reference to FIG. 1, and also to FIG. 2, a stepped, generally cylindrical mandrel 18 of non-magnetic material, for example aluminum, includes opposed lesser diameter cylindrical portions 20 at its ends supporting the mandrel on brackets 21 fixed to frame structure 11. A pair of opposed, cylindrical shoulder portions 22 on the mandrel support press-fitted inner races of a pair of ball bearings 23. The outer races of bearings 23 support a pair of press-fitted rings 24. The outer end portions **24*a* of rings 24 are cogged to mesh with cog teeth 17*a* on belts 17, and intermediate portions 24*b* of the rings 24 are threaded to receive internally threaded glands 25**.

Each ring 24 further includes an abutment portion 26 which, in cooperation with a gland 25, defines a radially outwadly presented annular groove (FIG. 2) within which is nested a deformable gasket in the form of an O-ring 27. Each gland 25 includes a laterally projecting offset 25*a* disposed in abutting engagement with a corresponding O-ring. Belt 14 which is formed of a relatively thin metal that is weakly ferromagnetic, preferably nickel about 3 mils thick, is formed about mandrel 18 as a cylinder about 6 inches in diameter and about 6 inches long. The belt is supported in the described cylindrical configuration on the outer circumference of O-rings 27. Support of belt 14 on O-rings 27 is both frictional and fluid-tight, as is achieved by threaded positional adjustment of glands 25 deformably to clamp the O-rings between offset portions 25*a* and abutments 26. Deformation is such that outer peripheral portions of the O-rings are urged radially outwardly against the inner periphery of the end regions of belt 14 in provision of the desired supporting engagement.

Figure 3:
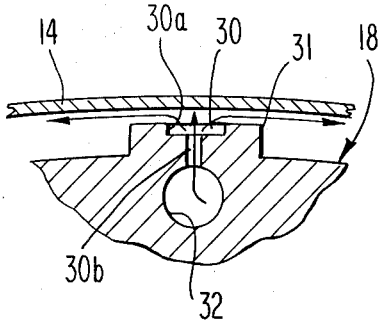
FIG. 3 is a fragmented, enlarged sectional showing of a portion of the apparatus seen in FIG. 1.

Still with reference to FIGS. 1 and 2, and further to FIG. 3, the central peripheral portion of mandrel 18 includes five longitudinal rows of a plurality of evenly spaced, radially presented fluid discharge orifices 30, six being shown in this embodiment, that are disposed in circumferentially evenly spaced lands 31. Typically, the width of a land 31 equals about 8° of included arc of the mandrel's circular cross section, and its elevation is about 0.10 inch above the intervening mandrel surface. Each orifice 30 includes a cylindrical, recessed discharge portion 30*a*, typicaly about 0.010 inch deep by 0.250 inch diameter, and a lesser diameter portion 30*b* of about 0.055 inch. Each of the orifice portions 30*b* communicates with fluid supply cavity means defined by a series of bores 32. Fluid is fed to the supply cavities under pressure, from a suitable source 28 through manifold means 33 of convenient annular configuration.

A magnet cavity 34 of generally rectangular, box-shape extends through a central region of mandrel 18, transversely of its axis of curvature. One set of orifices 30, and its corresponding lands 31 and fluid supply cavity 32, extend across one end of magnet cavity 34. A central bore 29 extends through mandrel 18, in fluid communication with magnetic cavity 34. The right-hand end of mandrel 18 (FIG. 2) is provided with a sealing cap 39 for bore 29, and a conduit 40 leads from the left end of bore 29 to suitable pressure regulating means 41.

Magnet structure 35 is disposed in cavity 34, and includes an array of parallel, rectangular pole pieces 36 interspersed by magnet sections 37, the polarity of which is indicated by the letters N and S, extending from a non-magnetic base portion 37*a*. A pole piece 36*a* extends transversely of the aligned bases of pole pieces 36 and magnets 37. The free ends of outer ones of pole pieces 36, and the magnets 37, terminate within cavity 34. As is best seen in FIG. 1, the free ends of the inner ones of pole pieces 36 are disposed astride land 31, and extend for a very short distance outside the cavity to within a very short distance of the surface of lands 31. The end of right-hand pole piece 36 is flat, and the end of left-hand pole piece 36 is generally wedge shaped.

The magnet array 35 thus far described affords a strong flux path "F" extending from the flat end of right-hand pole piece 36 and through belt 14 at one density, thence forming a loop to extend through belt 14 at considerably higher density into the wedge-shaped end of pole piece 36. An external magnet 38 is disposed just above belt 14, over the left-hand pole piece 36, and cooperates with magnet array 35 and the weak magnetic characteristic of belt 14 in formation of the elongate magnetic ink bead 13*a* (FIG. 1) on belt 14, as will be described in what follows.

In operation, and with reference to FIGS. 1, 2, and 3, feed hopper 12 is supplied with dry magnetic ink 13, also known in the art as toner. Belt 14 is driven by dual cog belts 17 in the direction of arrow "A" on FIG. 1. As belt 14 passes hopper 12, ink 13 is fed onto the surface of the belt which, in accordance with known practice, is provided with a roughened finish affording a sufficiently high coefficient of friction cooperating with the magnetic characteristic of the belt to transport the finely divided particles of ink 13. As the ink is carried counter-clockwise on the belt, it enters the magnetic field generated by magnet array 37 and magnet 38. The high density flux path of the field "F" attracts a line of particles of ink 13, and the magnetic field, in cooperation with the frictional force exerted by belt 14 on the ink particles, creates a non-translating, rotating elongate bead 13*a* of ink 13 extending transversely on the surface of the belt, as seen more clearly in FIG. 2. The rotating bead 13*a* advantageously operates uniformly to distribute ink 13 over the outer surface of the belt as a coating suitable for printing as it passes print station 16.

In concert with rotation of belt 14 on bearing 23, and in particular accordance with the invention, fluid such as air, is supplied by source 28 to mainfold 33, under pressure in a range from about 20 to 50 p.s.i., for uniform flow to each of air cavities 32. Air flowing through these cavities is discharged through orifices 30. As is best seen in FIG. 3, air undergoing discharge flows first through orifice portion 30*b* then into less restrictive portion 30*a* at a reduced pressure of about 10 p.s.i.. This low pressure air then flows at reduced velocity into the relatively close space (i.e. about 0.10 inch) between the mandrel 18 and the belt 14. The aforesaid space is defined in part by lands 31 and the ends of the larger diameter portion of mandrel 18 where it is in fluid flow communication with annular passages 42 defined by the aforesaid mandrel ends and ring 24. The air thus discharged flows uniformly and slowly through the aforesaid space under the mentioned pressure of about 10 p.s.i., and uniformly urges belt 14 outwardly to rigidify the same in maintenance of its desired cylindrical shape. Pressurized air flows from certain of the aforesaid spaces directly into magnet cavity 34, at 34*a* on FIG. 2, and is discharged through bore 29 to pressure regulating means 41. Air flowing from other of the spaces enters annular passages 42, flowing thence to another space communicating with magnet cavity 34, for flow therethrough to bore 29 and discharge to the pressure regulator 41.

Contributing to maintenance of the pressurization of air between mandrel 18 and belt 14 are labrynth-type fluid seals including wide sleeve portions 24*c* on the inner periphery of rings 24 extending in closely spaced relation over reduced diameter portions 18*a* of mandrel 18. It will, of course, be understood that other known sealing means may be resorted to for ensuring uniform fluid pressure to rigidify cylindrical belt 14.

It will be appreciated that the belt is held along its edges by O-rings 27 against axial and radial movements, and in the desired fluid sealing relation to the mandrel. The overall effect is accurate moving-fluid support of belt 14 relative to magnet array 35, without destructive cyclic strains.

Moreover, the disclosed belt support structure affords uniform close proximity (e.g. about 1 to 2 mils) of the inked surface of belt 14, to the web of paper 15 as it moves over selectively energizable electrostatic printing head 16 operable to transfer ink 13 from belt 14 onto the paper. Although only a single head 16 is shown, it will be understood that an in-line array of such heads is contemplated, as will be the case when the disclosed apparatus is used as a computer print-out means. It will be further understood that instead of paper 15 an image drum may be cooperably disposed adjacent belt 14 and operate as an ink receptor in formation of a latent image thereon for subsequent printing.

DESCRIPTION OF THE MODIFIED EMBODIMENT

Figure 4:
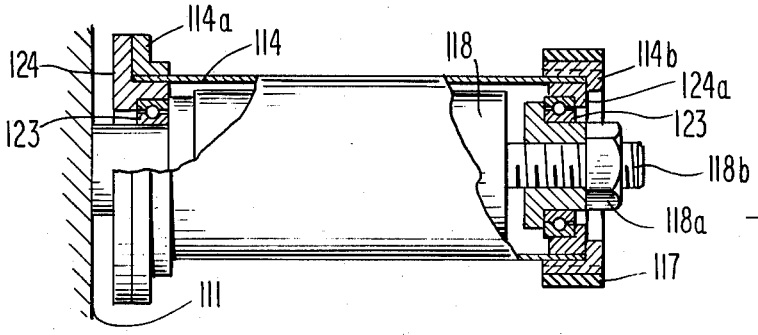
FIG. 4 is a partial sectional showing similar to FIG. 2, and illustrating a modified embodiment of the invention.

In the modified embodiment of the transport belt structure illustrated in FIG. 4, a mandrel 118 is supported toward its one end on suitable base structure 111. As were provided in the preferred embodiment, air cavities, orifices, and bead-forming magnetic means, are provided in mandrel 118, none of which need be shown for an understanding of the modified embodiment. Mandrel 118 has press-fitted thereon a pair of ball bearings 123, the left-hand bearing 123 supporting a flanged ring 124 and the right-hand bearing supporting a flanged ring **124*a***.

An ink transport belt 114 of relatively thin metal, for example nickel as in the preferred embodiment, extends over cylindrical portions of rings 124, **124*a* in substantially fluid-tight relation therewith. A flanged ring 114*a* fastened to belt 114 is attached to flanged ring 124, and an opposite flanged ring 114*b* fastened to belt 114 has its flange extending inwardly over right-hand bearing 123**.

Support of right-hand bearing 123 on mandrel 118 is provided by a flanged nut **118*a* adjustably threaded onto a suitably threaded right-hand end portion 118*b*** of the mandrel.

Construction and arrangement of the modified embodiment is such that belt 114 can be pre-tensioned by threaded adjustment of nut **118*a* to the right. The belt is further rigidifed, as in the preferred embodiment, by introduction from suitable passage means of air under pressure into the air space between the mandrel and the belt. Rotation of belt 114 is provided by a suitably driven drive belt 117 wrapped as shown about the outer flange on ring 114*b*. The presently disclosed single belt drive may be resorted to for relatively narrow toner belts, whereas a dual belt drive, as disclosed in FIGS. 1 and 2**, is preferred for relatively wide toner belts.

It will be appreciated that the invention advantageously affords magnetic toner transport belt structure utilizing a relatively thin toner transport belt that accommodates optimum spacing of toner bead forming magnet means, while achieving substantially strain-free, dimensionally accurate support of the thin transport belt.

While in each of the disclosed embodiments air has been used as the preferred pressurized fluid medium, it will be understood that other gases, as well as liquids, are contemplated by the invention. Also, it will be understood that changes in form and details of construction may be resorted to, and that such changes as these and the above-mentioned changes can be made without departing from the scope of the appended claims.

What is claimed is:

1. In magnetic particle transporting apparatus of the type in which an endless metal belt of relatively thin cross-section is passed across magnet means effective to form a non-translating, rotating elongate bead of magnetic particles across the direction of travel of said belt to distribute said particles in a uniform layer for removal from said belt in a transfer region, the combination of: a generally cylindrically shaped mandrel, rotatable means along edge regions of said belt for supporting said belt on said mandrel in the shape of a cylinder and providing for rotation of said belt about its axis of curvature; and means for introducing fluid under pressure in the region enclosed by said belt and said mandrel uniformly to urge said cylindrically formed belt outwardly, effectively rigidifying the same to maintain predetermined optimum spacing between said belt and said magnet means for the recited formation of said bead of particles.

2. Apparatus according to claim 1, and characterized in that said rotatable means comprises: at least a pair of bearing means, each supported on said mandrel in the region of a recited edge portion of said belt; and sealing ring means on each said bearing means affording substantially fluid tight support of said belt on said bearing means.

3. Apparatus according to claim 1, wherein said generally cylindrically shaped mandrel is provided with fluid supply cavities therein; and further characterized in that said means for introducing fluid under pressure comprises: a plurality of equally spaced lands on the cylindrical surface of said mandrel in close, radially spaced relation to the inner surface of said belt; and means defining a plurality of radially presented fluid discharge orifices in said lands, said orifices being disposed in fluid flow communication with said fluid supply cavities.

4. Apparatus according to claim 3, and characterized in that said rotatable means comprises: at least a pair of bearing means, each in the region of a recited edge portion of said belt; sealing ring means on each said bearing means affording substantially fluid tight support of said belt on said bearing means; and means for controlling fluid pressure in the region enclosed by said belt and said mandrel.

5. Apparatus according to claim 2, and characterized further in that said each sealing ring means comprises a deformable gasket, and means selectively adjustable to deform a corresponding one of said gaskets into substantially fluid tight sealing engagement with said belt.

6. Apparatus according to claim 3, and characterized further in that each said orifice comprises a bore of reduced diameter leading from a corresponding one of said fluid supply cavities, and a bore of substantially increased diameter leading to the outer surface of a corresponding land and through which fluid is discharged to the space between said mandrel and said belt.

7. Apparatus according to claim 3, and characterized further in that said mandrel includes means defining a cavity within which elements of said magnet means are supported.

8. In apparatus for transporting finely divided magnetic particles from a bulk source for delivery to a transfer region in a uniformly dispersed layer, the combination of: fixed, non-magnetic mandrel structure of generally cylindrical shape, said structure including a cavity extending transversely of the central axis thereof; a plurality of evenly circumferentially spaced lands extending longitudinally of the surface of said mandrel structure; means defining radially presented fluid discharge orifices in each of said lands; means defining cavities in said mandrel structure for feeding fluid under pressure to said orifices for discharge therefrom; a relatively thin, cylindrically formed magnetic particle transporting belt disposed coaxially about said mandrel structure; bearing means supporting said belt for rotation about said mandrel structure; magnet means disposed within said transversely extending cavity in said mandrel and including magnetic flux-concentrating pole pieces disposed in close proximity to said belt and extending parallel to the axis thereof; and means for driving said belt on said bearing means.

9. Apparatus according to claim 8, and characterized in that said bearing means includes O-ring sealing gasket means thereon affording both the recited belt support and a substantially fluid tight seal of the region enclosed by said belt and said mandrel.

10. Apparatus according to claim 8, and characterized by the inclusion of fluid sealing means interposed between said belt and said bearing means, and means for controlling fluid pressure in the region enclosed by said belt.

11. Fluidically supported ink transporting belt means for use in printing apparatus of the type utilizing dry magnetic ink as the recording medium, comprising: means defining a generally cylindrical mandrel having fluid supply cavities and a magnet support cavity; a thin flexible cylindrically formed weakly magnetic metallic belt disposed coaxially with and closely spaced about said mandrel; means supporting said belt in substantially fluid tight relation along opposed edge regions thereof and affording rotation of said belt about said mandrel; means defining radially presented orifices in said mandrel and communicating with said fluid supply cavities and with the relatively close space provided between said belt and said mandrel; a magnet in said magnet cavity having pole pieces so shaped and disposed as to maintain a magnetic field parallel to the axis of and extending transversely across the surface of the cylindrically formed belt; means for rotating said belt about said mandrel; means for dispersing dry magnetic ink over the surface of said belt; and means for introducing fluid under pressure into said fluid supply cavities for flow through said orifices into the recited space, said fluid being effective substantially to pressurize said space and rigidify said belt as it rotates, said magnetic field being effective to form and maintain a non-translating, elongate rotating pencil like rotating ink bead on the surface of said belt as it rotates.

* * * * *